United States Patent [19]

Gattu et al.

[11] Patent Number: 4,496,062

[45] Date of Patent: Jan. 29, 1985

[54] CRANE HAVING STABILIZING OUTRIGGERS

[75] Inventors: Narahari Gattu; Joseph C. Terranova, III, both of Cedar Rapids, Iowa

[73] Assignee: Harnischfeger Corporation, West Milwaukee, Wis.

[21] Appl. No.: 472,732

[22] Filed: Mar. 7, 1983

[51] Int. Cl.[3] ..... B66C 23/62

[52] U.S. Cl. ..... 212/189; 280/765.1; 254/93 R

[58] Field of Search ..... 212/189; 280/764.1, 280/765.1; 248/354 H; 254/418

[56] References Cited

U.S. PATENT DOCUMENTS

| | | | |
|---|---|---|---|
| 2,777,586 | 1/1957 | Boysen et al. | 212/189 |
| 3,836,012 | 9/1974 | Grider | 212/189 |
| 3,854,595 | 12/1974 | Kuhn | 212/189 |

*Primary Examiner*—Trygve M. Blix
*Assistant Examiner*—Patrick W. Young
*Attorney, Agent, or Firm*—James E. Nilles

[57] ABSTRACT

A mobile crane of the type having an upper revolvably mounted on an elongated main frame. The main frame has a central tub for mounting the upper and also has a series of ground-engaging wheels along the main frame and at either side thereof. Power-operated outrigger assemblies are provided for being swingable on the main frame and between the radially outward stabilizing position and a transport, storage position along side the main frame. The outrigger assemblies are elongated and have a rectangular in cross-section shape, one of the axes of the cross-section being greater than the other so as to provide a generally flat in cross-section outrigger. The outriggers can be rotated about their longitudinal axes for about 90° whereby when the outrigger is in the stabilizing position, the major transverse axis is in the vertical direction and when the outrigger is in the storage position, its major axis is in the horizontal position so that the outriggers can be compactly stored above the wheels and along side the main frame of the crane.

3 Claims, 14 Drawing Figures

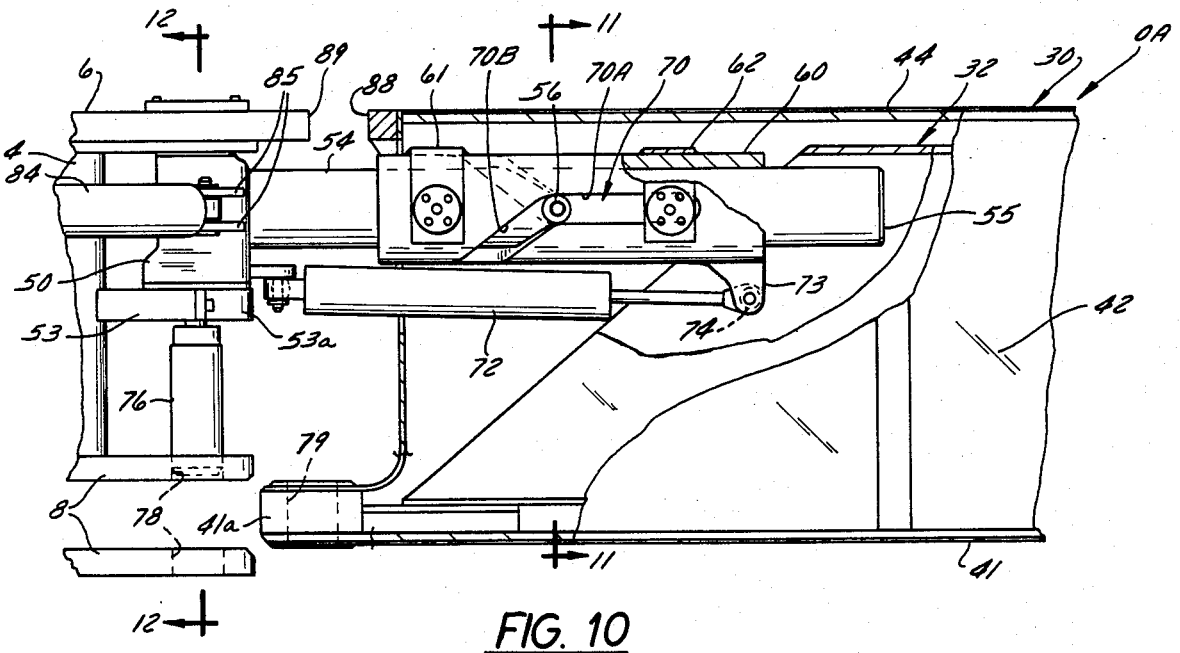
FIG. 10
FIG. 11
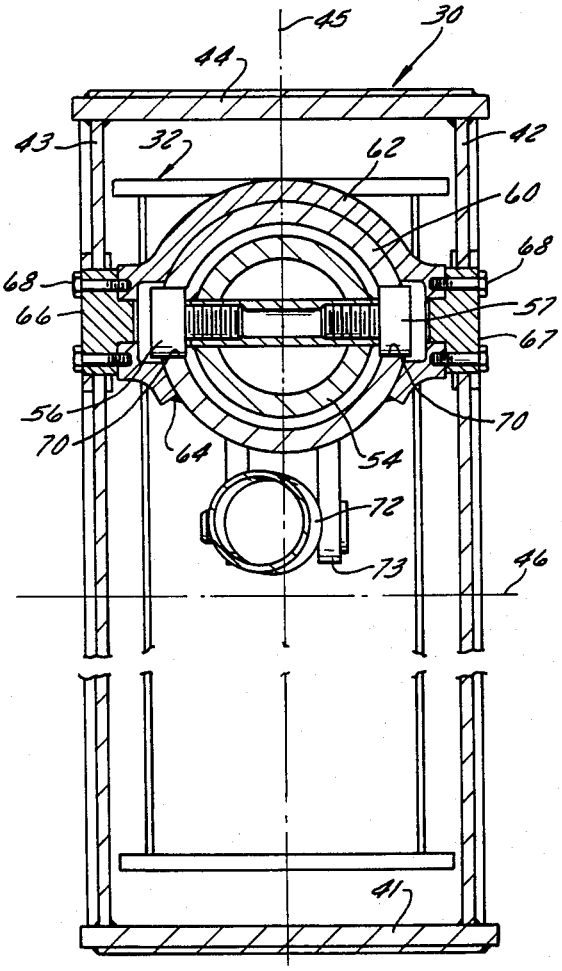
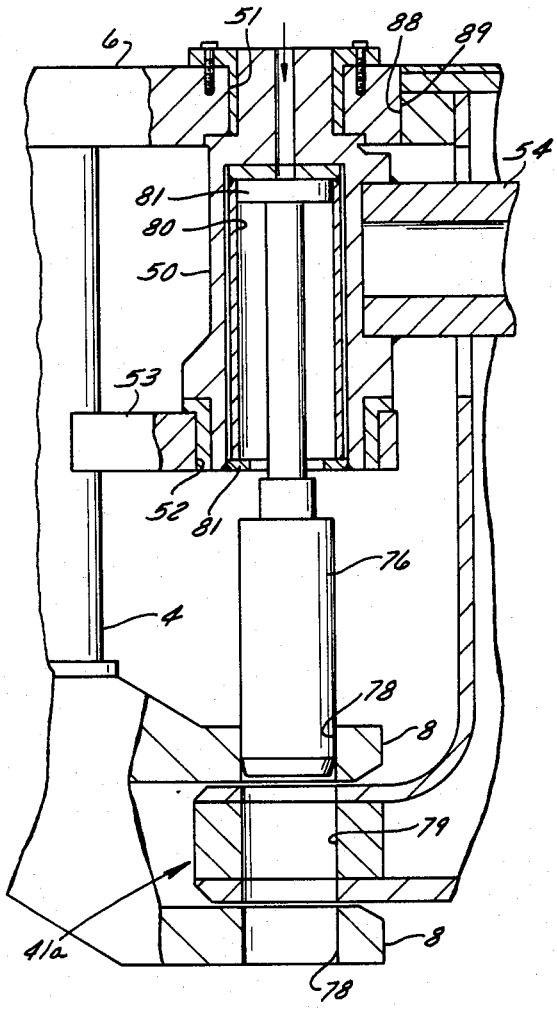
FIG. 12

CRANE HAVING STABILIZING OUTRIGGERS

BACKGROUND OF THE INVENTION

This invention pertains to mobile cranes of the type having booms which may be extended hundreds of feet into the air and which also include ground-engaging wheels which render the crane mobile. Cranes of this type employ radially extending outriggers for stabilizing the crane when in the operative position. An example of such a crane is shown in the U.S. patent applications Ser. Nos. 203,941; 203,942; 203,943 and 203,944 all filed Nov. 7, 1980. In cranes of that type, as well as other prior art cranes, the outrigger assemblies are swingable along side the wheels of the crane when the latter is to be transported; and this creates a wide crane, particularly when of the extremely large size.

The present invention provides a wheeled crane of the type having a boom carried by a revolvable upper that is mounted on an elongated main frame. The elongated main frame has a series of ground-engaging wheels along its length and on either side of the main frame. More specifically, the present invention provides radially swingable outriggers for such a crane and which can be not only swung from a radially extending stabilizing position to a transport position along the main frame; but the invention furthermore contemplates means for rotating the rectangular in cross-section outrigger assemblies about their longitudinal axes so that the outriggers can be rotated from a stabilizing position in which their major transverse axis is in a vertical direction to a transport position in which the major transverse axis of the outrigger is in a horizontal position and the outrigger can be stored above the wheels and compactly along the side of the main frame. The invention furthermore contemplates power means for not only rotating the outrigger assembly about its longitudinal axis approximately 90°, but also provides for positively shifting the outrigger against the main frame for being locked therewith, and away from the main frame to facilitate rotation of said outrigger about its axis through the 90° travel. Power means are also provided for positively locking the outrigger assemblies to the main frame in the stabilizing position.

These and other objects and advantages of the present invention will appear hereinafter as this disclosure progresses, reference being had to the accompanying drawings.

DRAWINGS

FIG. 10 is a view similar to FIG. 9 but showing the outrigger in the unlocked position and spaced from the main frame;

FIG. 11 is a sectional view taken along line 11—11 in FIG. 10 but on an enlarged scale;

FIG. 12 is a sectional view taken along line 12—12 in FIG. 10 but on an enlarged scale;

Figure 13:
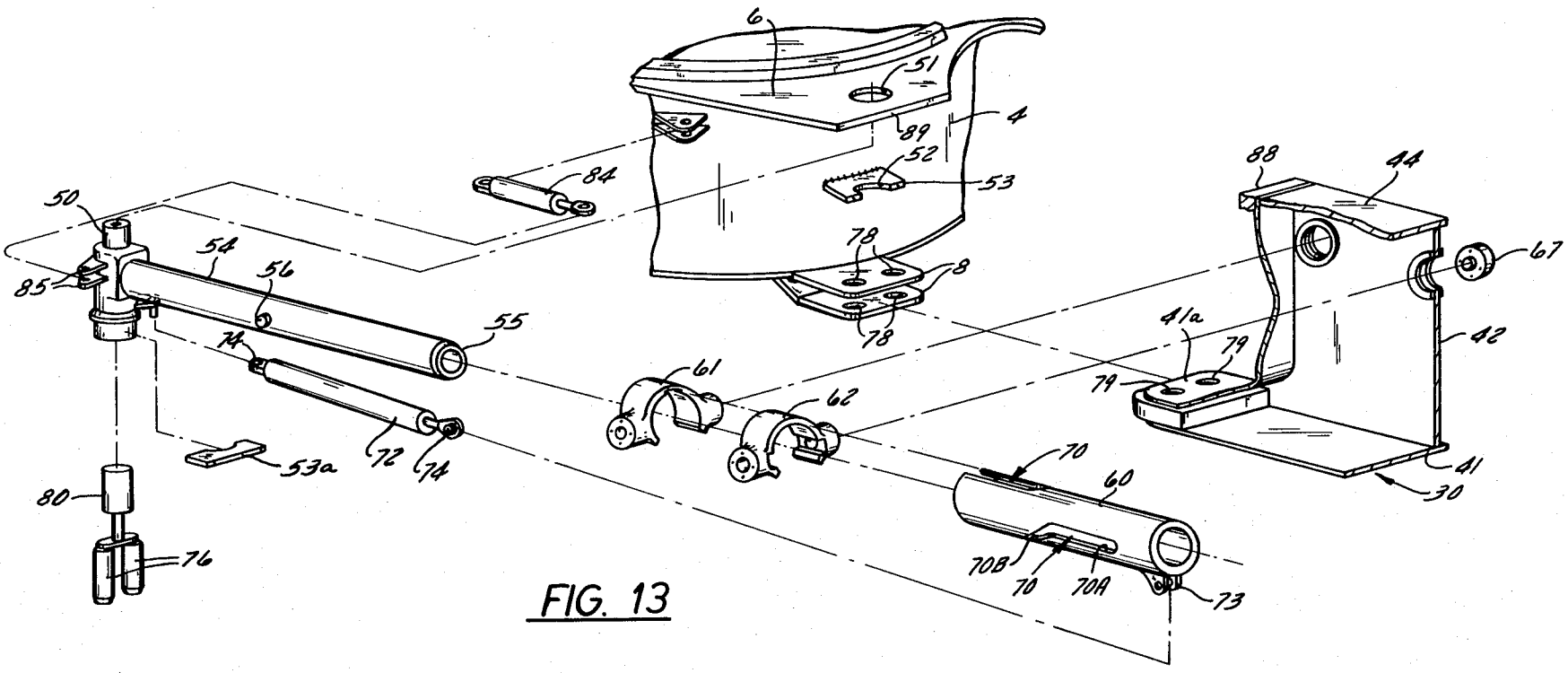
Figure 14:
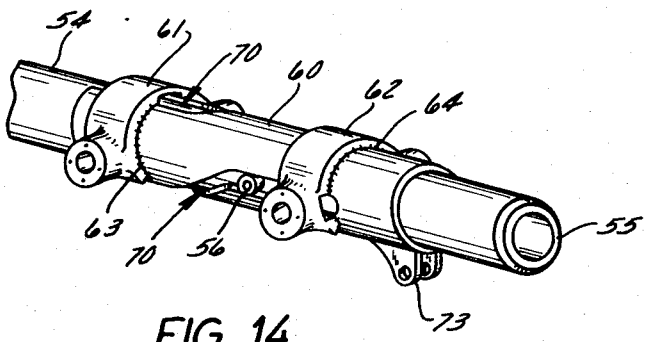

FIG. 13 is a perspective, exploded, fragmentary view of a portion of the main frame, an outrigger and the power actuating means between the main frame and the outrigger and which is used for swinging the outrigger relative to the main frame, rotating the outrigger about its longitudinal axis, and for shifting the outrigger toward and away from the main frame for locking and unlocking it with respect to the main frame; and FIG. 14 is a perspective view of part of the means shown in FIG. 13 for rotating the outrigger about its own longitudinal axis.

DESCRIPTION OF A PREFERRED EMBODIMENT

Figure 2:
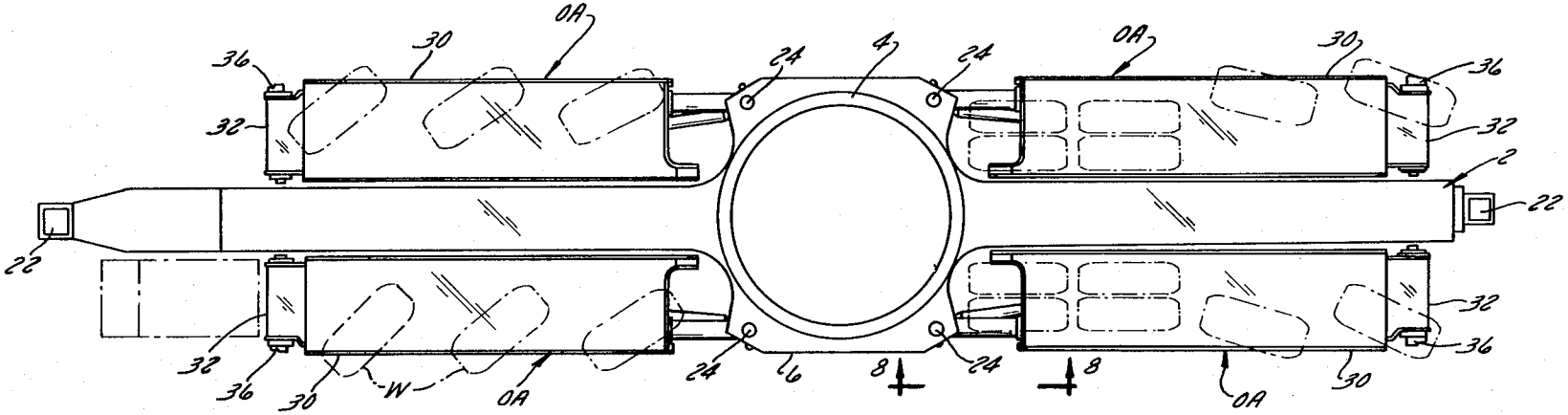
FIG. 2 is a plan view, schematic in nature, of the crane shown in FIG. 1.
Figure 1:
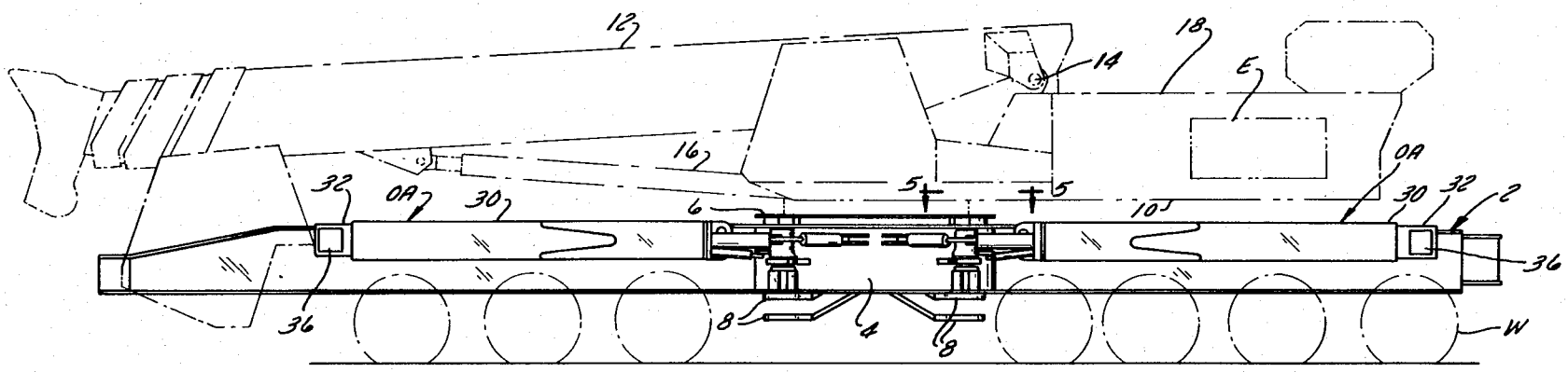
FIG. 1 is a side elevational view of a rubber-tired crane embodying the present invention and showing the outriggers in transport position.

The general organization of a rubber-tired crane with which this invention finds utility is shown schematically in FIGS. 1 and 2 and includes an elongated main frame 2 fabricated from sheet steel and comprising a generally retangular in cross-section shape. This frame may be of the type shown in the U.S. application Ser. No. 203,941 filed Nov. 7, 1980, and assigned to an assignee common with the present invention. This main frame 2 includes a central tub 4 which is of a generally vertical cylinder shape and has a generally horizontal plate 6 welded thereto. The main frame also includes four pairs of parallel plates 8 extending from circumferentially spaced locations from the lower side of the tub. The crane includes a revolvable upper 10 which is mounted in and supported by the tub 4 in the known manner. A telescoping boom 12 is mounted about a horizontal axis 14 on the upper 10 and can be vertically positioned by the large hydraulic cylinder 16 in the known manner. A rear portion 18 of the upper acts to counterbalance the oppositely extending boom 12 and would include an engine E as is well known. The crane also includes a series of ground-engaging wheels W which can be powered by a separate power source and transmission mechanism not shown.

Each end of the main frame may contain a vertically positionable ground-engaging jack 22 such as shown in the co-pending U.S. application Ser. No. 203,943 filed Nov. 7, 1980, and which has been assigned to an assignee common to the present invention.

A plurality of outrigger assemblies OA are each pivoted to the main frame about the vertical axis 24. Four such outrigger assemblies have been shown and act as stabilizers when in the working position so as to provide stability to the crane when in the operating mode. Such telescoping outriggers and power-operated screw means therefor are shown in the U.S. application Ser. No. 203,942 filed Nov. 7, 1980. The outriggers shown in that patent are swingable from a radially outward stabilizing position, to a laterally inward position alongside the main frame. These outriggers are positioned, when in the transport position, outwardly of the ground-engaging wheels and, consequently, add to the overall width of the crane.

Figure 4:
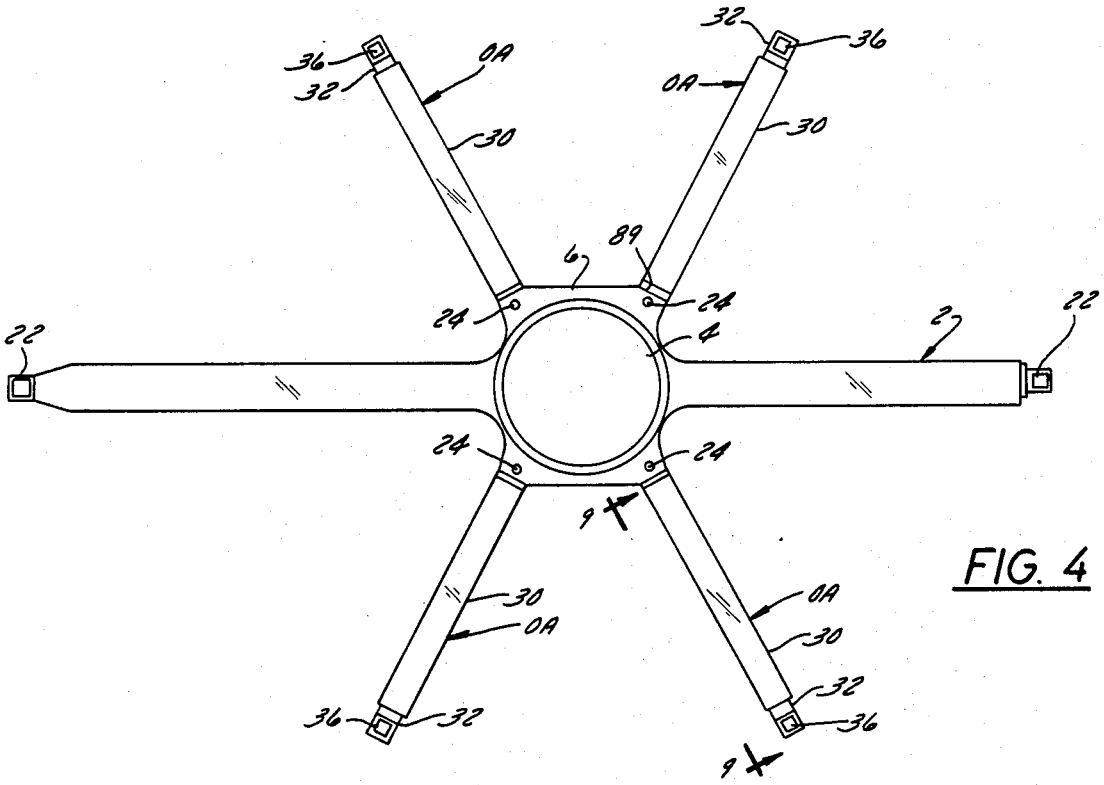
FIG. 4 is a view similar to FIG. 3 but showing the outriggers when they have been rotated 90° about their individual longitudinal axis and have also been shifted inwardly to a locked position thereby assuming a fully operative position.

The present invention provides outrigger assemblies which can be swung from a stabilizing, operative position shown in FIG. 4 to a transport position shown in FIG. 2. When in the transport position shown in FIG. 2, it will be noted that the outrigger assemblies rotate 90° about their individual longitudinal axes from the position shown in FIG. 4. Thus, when in the transport position of FIG. 2, they have been rotated to a horizontal, flat position with respect to their machine transverse axis and are located above the ground-engaging wheels. In this manner the overall width of the crane when in the transport position has been reduced.

Referring more specifically to the outrigger assemblies, their construction and their mounting means, each of the four outrigger assemblies is similar in structure and function and, consequently, only one will be described in detail.

Figure 9:
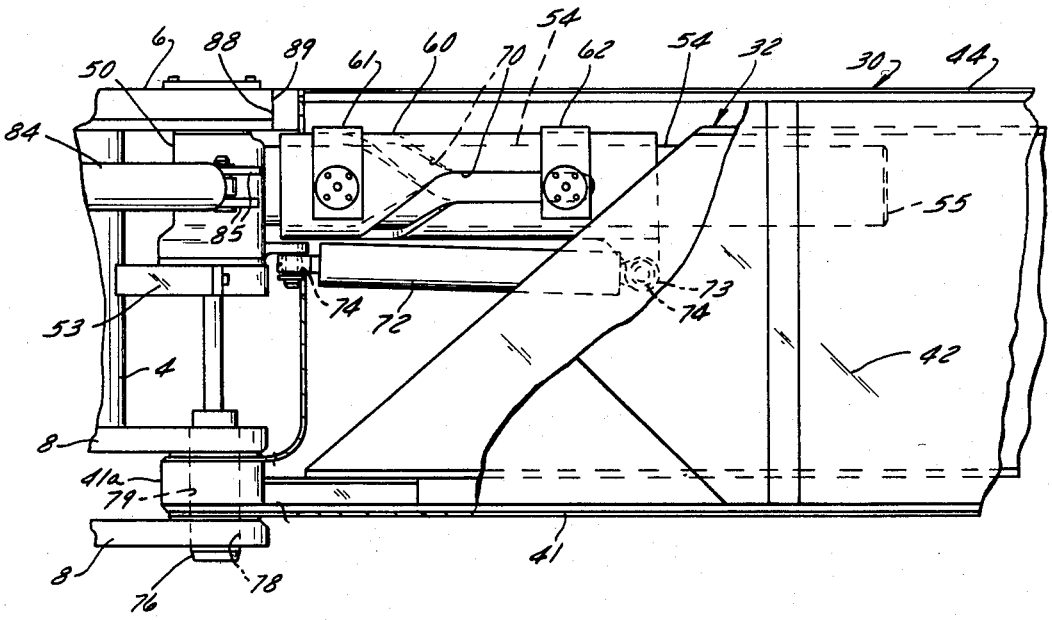
FIG. 9 is a fragmentary, enlarged, side elevational view, taken generally along the line 9—9 in FIG. 4, and showing a portion of the outrigger and main frame when the outrigger is in the fully locked, operative, crane supporting position.

The outrigger assemblies are fabricated into a rectangular, cross-sectional shape and are of steel plate construction. The assemblies include an outer box-like portion 30 in which is telescopingly mounted an inner box-like portion 32 (FIG. 9). It will be understood that the inner portion 32 is telescopingly extendable in the outer portion 30, and it is believed sufficient to say that the means for so telescoping the outrigger assemblies may be of the type shown in the said U.S. Ser. No. 203,942. As the means for telescopingly extending the outriggers forms no part of the present invention, details concerning it will not be referred to.

Adjacent the outer end of each of the outriggers is a vertically positionable jack 36 which may be of the type shown in the U.S. Ser. No. 203,943 filed Nov. 7, 1980, but as these jacks form no part of the present invention, further reference to their details will not be made.

Referring further to the details of the outrigger assemblies, the outer box-like portion 30 includes a bottom plate 41, two opposite side walls 42 and 43 and top plate 44 which are all fabricated together by welding to form a unitary, box-like, elongated structure which is rectangular in cross-section. As shown in FIG. 11, the outrigger assembly is of rectangular cross-sectional shape and has a greater transverse axis 45 and a lesser transverse axis 46.

It will be noted that the bottom plate 41 has a protruding portion 41*a* at its inner end and which is adapted to be received between the spaced, parallel plates 8 of the main frame, when the outrigger has been swung to the radially outward position shown in FIG. 4.

Figure 3:
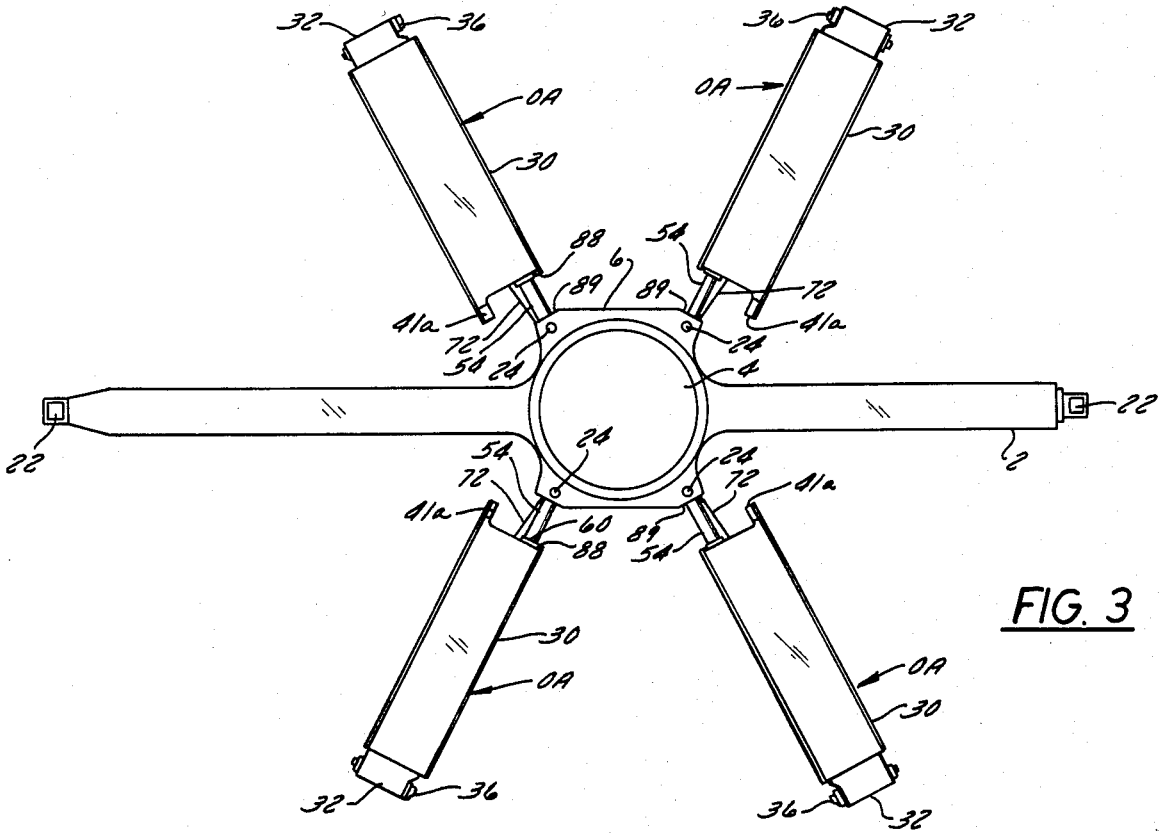
FIG. 3 is a schematic view of the main frame of the crane and showing the outriggers when swung to their radially outer position, but before the outriggers have been rotated about their axes through 90°.

A mechanism, as is clearly shown in FIG. 13, is provided for each of the outriggers and for swingably mounting the outriggers in the main frame, and more specifically, on the tub portion of the main frame. This mechanism provides a means for swinging the outriggers relative to the main frame and between the transport position shown in FIG. 2 and the stabilizing, operative position shown in FIG. 4. This means also is capable of rotating the outrigger assemblies 90° about their individual longitudinal axes, namely, between the horizontally, flat storage position shown in FIG. 2 over the wheels, and the stabilizing, operative position shown in FIG. 4 where the major transverse axis of the outrigger is disposed in the vertical direction. In addition, this mechanism provides for shifting the outrigger assembly between a position spaced from the tub as shown in FIG. 3 and the position shown in FIG. 4 where the outrigger assemblies are locked to the main frame in the stablizing position. Reference will now be made in greater detail to the actuating mechanism for the outrigger assembly.

The outrigger assembly is supported on the main frame as follows. A vertical post 50 is mounted at its upper end in aperture 51 in the horizontal plate 6 (FIG. 13) and is also mounted at its lower end in the apertured bracket 53 which is welded to the tub. Rigidly secured to and extending from vertical post 50 is a tubular support arm 54 which extends axially into the outrigger assembly and terminates in the free end 55. As clearly shown in FIGS. 11 and 13, cam roller followers 56 and 57 are rigidly secured to the arm 54 and extend at either side thereof. A tubular cam member 60 is rigidly secured by brackets 61 and 62 to the interior of the outrigger assembly member 30. As shown in FIG. 14, tubular cam member 60 is welded as at 63 and 64, respectively, to bearing brackets 61 and 62. The brackets 61 and 62 are fixed to the side walls of the outrigger assembly member 30 by means of the bushings 66 and 67 (FIG. 11), the bushings being rigidly secured to the side walls of the outrigger assembly by the cap bolts 68. Thus, the tubular cam member 60 is rigidly fixed to and within the outrigger assembly member 30 and rotation of the cam member 60 by means thus described causes similar rotation of the outrigger assembly.

Figure 7:
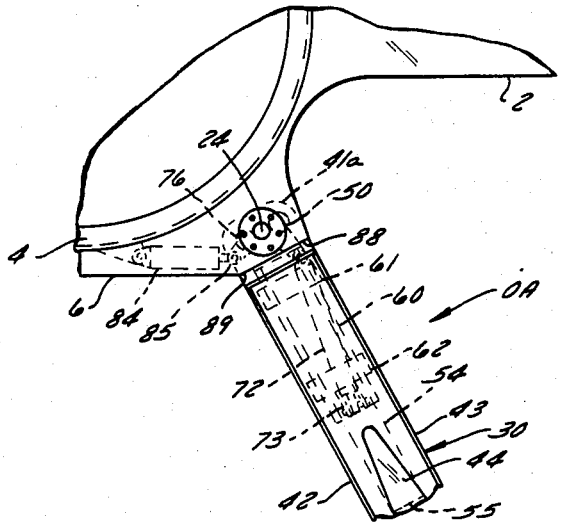
FIG. 7 is an enlarged, fragmentary view of one of the outriggers as shown in FIG. 4.
Figure 8:
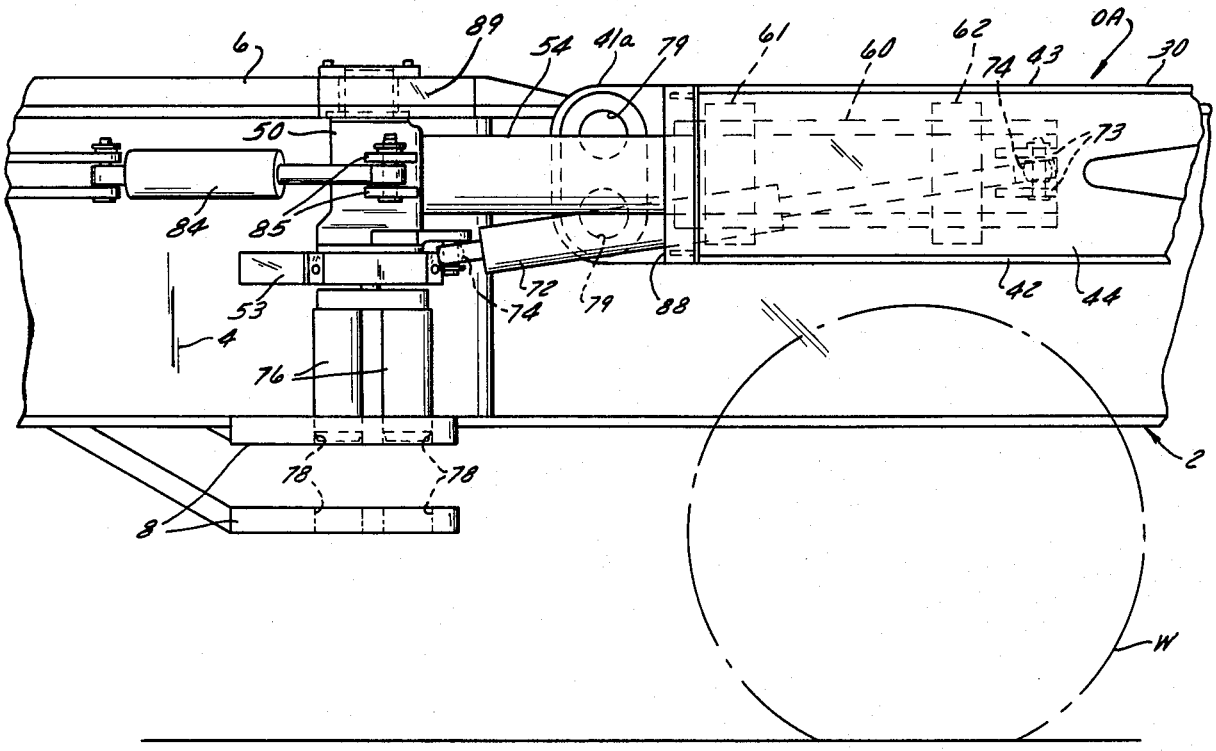
FIG. 8 is an enlarged, fragmentary, elevational view taken generally along the line 8—8 in FIG. 2.

The tubular cam member 60 has a pair of cam tracks 70 cut through its side walls. The cam tracks include an axially straight portion 70A (FIG. 13) and an axially inclined portion 70B. These cam tracks 70 receive the cam followers 56 and 57 that are fixed to the support arm 54. A double-acting hydraulic cylinder 72 is secured at each end by spherical bushings 74 to the vertical post 50 and to the bifurcated brackets 73 at the outer end of the tubular cam member 60. Extending and retracting the double-acting cylinder 72 causes the tubular cam member and its outrigger assembly to be axially shifted when followers 56 and 57 are in the inclined portion 70B of the cam member, that is toward or away from the main frame. This shifting movement causes the tubular cam member 60 to rotate about its longitudinal axis, when followers 56 and 57 are in the inclined portion 70A of the cam track 70, carrying with it and also rotating the outrigger assembly OA. Thus, bodily rotation of the outrigger assembly about its longitudinal axis is caused by the cam track portion 70B of cam member 60 being urged over the cam followers 56 and 57, the latter of which are fixed relative to the main frame. In this manner, as the hydraulic cylinder 72 is actuated in one direction or the other, the outrigger assembly is caused to rotate 90° between a position in which the major transverse cross-sectional axis 45 (FIG. 11) is in a "horizontal" position, i.e., a storage position, shown in FIGS. 2 and 5 and the position where the major axis 45 is in a vertical position as shown in FIGS. 4 and 7.

As shown in FIG. 10, the outrigger assembly is spaced somewhat from the tub or main frame so that it can rotate about the above-mentioned 90°. However, when the outrigger assembly is to be finally positioned in the stabilizing, operative position, with the major transverse axis 45 in a vertical position, as in FIG. 7, it must be urged against the main frame as shown in FIG. 9 and locked at that position. Thus, when the hydraulic cylinder 72 has been fully contracted, the outrigger assembly assumes the position of FIG. 9. The outrigger assembly is then locked in the operative position by the double-locking pins 76 which are forced into the aligned holes 78 in member 8 and the holes 79 in the lower portion 41*a* of the outrigger assembly member 30. These locking pins are positively inserted in and withdrawn from these aligned holes by means of the hydraulic cylinder 80 and its piston 81 located in the vertical post 50.

Hydraulic cylinder means 84 are provided between the main frame, that is tub 4, and the bifurcated brackets 85 (FIG. 13) fixed to the vertical post 50. The outrigger assembly is thus swingable between transport and stabilizing positions by contraction and extension of the double-acting hydraulic cylinder 84.

Figure 5:
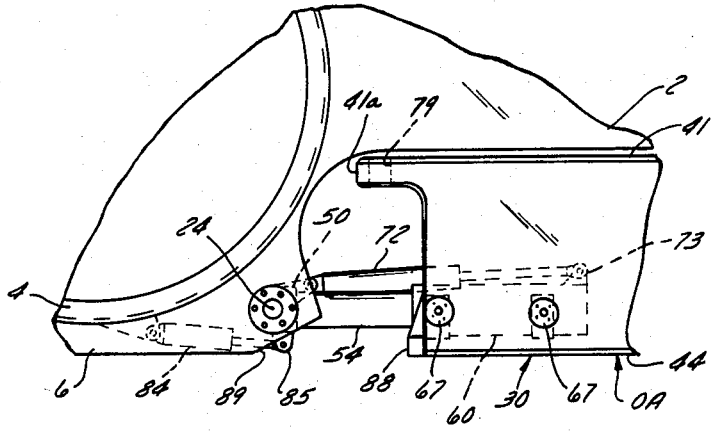
FIG. 5 is an enlarged, fragmentary plan view, taken generally along the line 5—5 in FIG. 1, of a portion of the outrigger when it has been shifted to a transport position as shown in FIG. 2.
Figure 6:
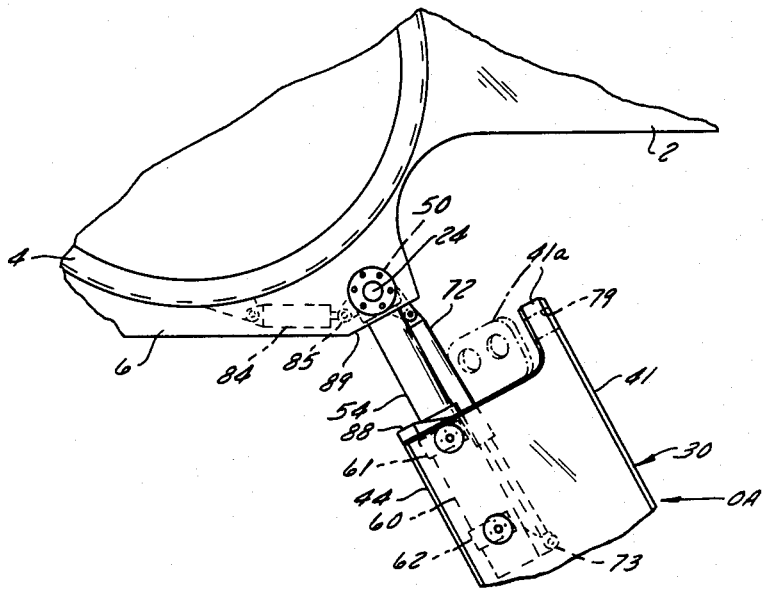
FIG. 6 is a view similar to FIG. 5 but showing the outrigger when swung radially outwardly but before it has been rotated 90° about its longitudinal axis.

In the above manner, the outrigger assembly can be swung from its storage position shown in FIGS. 2 and 5 where the major axis 45 is horizontal, that is the outrigger is in the "flat" position, and to the intermediate, unlocked, position shown in FIGS. 3 and 6. The outrigger assemblies are then rotated 90° about their longitudinal axes when the hydraulic cylinder 72 is actuated and followers 56 and 57 ride in cam track inclined portion 70B. The outrigger assembly is then in the intermediate position shown in FIG. 10. Further contraction of the cylinder 72 then urges the outrigger assembly inwardly towards the tub, and when the assembly has been fully engaged with the tub, the hydraulic cylinder 80 and piston 81 (FIG. 12) urge the locking pin 76 downwardly into the aligned holes 78 and 79 between the frame members 8 and the lower member of the outrigger assembly wall 41. The upper, inner end 88 (FIG. 10) then simply bears firmly against the surface 89 of the main frame.

What is claimed by the present invention is:

1. A crane having an elongated main frame and ground wheels located along the length of said frame on either side thereof for supporting said frame for travel along the ground; said main frame having a generally central portion, a revolvable upper mounted on said central portion, outriggers pivotably mounted to said main frame adjacent said central portion; means for pivotably mounting each of said outriggers to said main frame for swinging said outrigger between a radially extending, crane-stabilizing position and a transport position wherein said outriggers are located alongside said main frame and above said wheels; each of said outriggers being elongated and having a longitudinal axis and also having a major transverse axis and a minor transverse axis; power operated means for rotating said outriggers about their longitudinal axes whereby said major transverse axis of an outrigger assumes a horizontal position when said outrigger is stored alongside said main frame and above said wheels, and said major transverse axis assumes a vertical position when said outrigger is in said radially extending, crane-stabilizing position.

2. The crane as set forth in claim 1 further characterized in that said power operated means for each outrigger includes a support arm swingably mounted on said main frame adjacent said central portion and for supporting said outrigger, and cam and follower means connected between said support arm and said outrigger, and also including a power operated cylinder for shifting said outrigger on said support arm and causing actuation of said cam and follower means to thereby rotate said outrigger about its longitudinal axis.

3. The crane as set forth in claim 2 including means for detachably locking said outrigger to said main frame whereby said outrigger can be locked to said main frame in said crane-stabilizing position and can be unlocked and shifted away from said main frame along said support arm to permit said outrigger assembly to be rotated about its longitudinal axis.

* * * * *